United States Patent [19]

Matsumura et al.

[11] Patent Number: 4,728,034

[45] Date of Patent: Mar. 1, 1988

[54] CLEANING DEVICE UPON COLOR-CHANGE IN AN ELECTROSTATIC MUTLI-COLOR COATING APPARATUS

[75] Inventors: Teruaki Matsumura, Nagoya; Noriyasu Suzuki, Toyoda; Michitaka Moritani, Toyoda; Hirotsugu Takaba, Toyoda, all of Japan

[73] Assignee: Trinity Industrial Corporation, Tokyo, Japan

[21] Appl. No.: 826,865

[22] Filed: Feb. 6, 1986

[51] Int. Cl.[4] ..... B05B 15/02

[52] U.S. Cl. ..... 239/112

[58] Field of Search ..... 239/112, 113, 106, 119, 239/305, 1, 3, 8

[56] References Cited

U.S. PATENT DOCUMENTS

| | | | |
|---|---|---|---|
| 3,348,774 | 10/1967 | Wiggins | 239/305 |
| 3,674,205 | 7/1972 | Kock | 239/112 X |
| 4,163,523 | 8/1979 | Vincent | 239/112 X |

*Primary Examiner*—Andres Kashnikow

*Attorney, Agent, or Firm*—Cushman, Darby & Cushman

[57] ABSTRACT

In a cleaning device upon color-change in an electrostatic multi-color electrostatic coating apparatus comprising first and second color-change devices each for supplying paints of a multiplicity of colors, cleaning air and thinner selectively through the first and second paint supply channels respectively and a valve mechanism disposed near the coating machine for supplying a paint supplied from the first or second color-change device through the first or second paint supply channel to the coating machine by way of a common paint hose, the valve mechanism comprises first and second switching valves each having exit channels for two ways connected to the first or supply channel, and low pressure air and thinner supply valves disposed respectively to a manifold in communication with the paint hose in which each one of exit channels for the first and second switching valves is connected by way of the manifold to the paint hose, while each the other of exit channels for the switching valve is connected by way of the liquid discharging ON-OFF valve to a liquid discharge channel communicating with a liquid discharge tank.

2 Claims, 2 Drawing Figures

CLEANING DEVICE UPON COLOR-CHANGE IN AN ELECTROSTATIC MUTLI-COLOR COATING APPARATUS

BACKGROUND OF THE INVENTION

1. Field of the Invention

This invention concerns a cleaning device upon color-change in an electrostatic multi-color coating apparatus adapted to supply paints of a multiplicity of colors selectively under color-change to an electrostatic coating machine having an atomizing cup applied with a high voltage and rotationally driven at a high speed.

2. Description of the Prior Art

In an electrostatic multi-color coating apparatus for use in the coating of automobiles, the color of paint is often changed from one to another and cleaning for the inside of the coating apparatus is necessary on every color change for avoiding undesired mixing of colors. In such a case, it has been required to minimize the wasteful loss of paints upon color-change and to reduce the cleaning time upon color-change as short as possible.

In order to satisfy the foregoing requirements, it may be considered to situate a color-change device for selectively supplying paints of a multiplicity of colors near the electrostatic coating machine thereby shorten the paint supply channel connected between the coating machine and the color-change device so that the residual amount of paint in the paint supply channel is reduced.

However, if the color-change device is disposed near the coating machine, an excess load is undesirably applied to a reciprocator adapted to drive the coating machine in accordance with a predetermined coating pattern. In view of the above, the use of a considerably long paint supply channel has been inevitable.

Then, for shortening the cleaning time upon color-change, cleaning air and cleaning thinner at high pressure have been supplied from the color-change device to the paint supply channel to thereby rapidly clean the inside of the paint supply channel and the atomizing cup.

However, such a system involves another problem that the wasteful loss of the paint is inevitable and a great amount of paint and cleaning thinner are violently blown out from the cup of the electrostatic coating machine because a great amount of the cleaning thinner is supplied in a short time to the inside of the paint supply channel. They are overflown from and scattered around to the outside of the shroud disposed at the periphery of the cup of the coating machine for recovering the discharged liquid, to contaminate the peripheral equipments and the coating machine main body.

In order to suppress the wasteful loss of the paint, it has been proposed such a device in which a second color-change device smaller in size than the abovementioned color-change device is disposed near the electrostatic coating machine to shorten the paint supply channel connected between the second color-change device and the coating machine. Those paints used frequently, for example, white or red paint is selectively supplied from the second color-change device. For the cleaning upon color-change, cleaning air and cleaning thinner are alternately supplied from the second color-change device to the paint supply channel, the paint hose and the coating machine.

However, also in this case, if the cleaning air and the cleaning thinner at high pressure are supplied from the second color-change device, a great amount of paint is jetted out from the cup of the electrostatic coating machine, overflown from and scattered around to the outside of the shroud to contaminate the peripheral equipments or the coating machine main body, although the cleaning time can be shortened. Further, if the cleaning air and the cleaning thinner are supplied at low pressure from the second color change device in order to avoid this drawback, contamination occurs or paint color remains to the inside of a manifold disposed to the color-change device and having color-change valves, as well as to the inside of the paint supply channel connected therewith, whereby mixing of colors is resulted between paints used before and after the color-change to impair the quality of coating products.

OBJECT OF THE INVENTION

In view of the above, it is an object of this invention to provide a cleaning device upon color-change in an electrostatic multi-color coating machine which can reduce the amount of paint remaining in the paint supply channel by shortening the paint supply channel for supplying a paint of specific color thereby preventing the wasteful loss of the paint; shorten the time required for cleaning upon color-change by cleaning the paint supply channel connected with the color-change device and a paint hose connected to the coating machine simultaneously and separately; prevent paints of different colors from mixing with each other, and which is free from the drawback that the paint blown out from the atomizing cup of the electrostatic coating machine is overflown from and scattered around to the outside of a shround by the supply of an air at low pressure and a cleaning thinner at low pressure to the paint hose.

SUMMARY OF THE INVENTION

The foregoing object of this invention can be attained by a cleaning device upon color-change of an electrostatic multi-color coating apparatus comprising a first color-change device for supplying paints of a multiplicity of different colors, a cleaning air and a cleaning thinner selectively through a first paint supply channel, a second color-change device smaller in size than the first color-change device disposed near the electrostatic coating machine for supplying paints of a multiplicity of different colors, a cleaning air and a cleaning thinner selectively through a second paint supply channel and a valve mechanism disposed near the electrostatic coating machine for supplying a paint supplied from the first color-change device or the second color-change device through the first paint supply channel or the second paint supply channel to the electrostatic coating machine by way of a common paint hose, wherein the valve mechanism comprises a first switching valve having exit channels for two ways connected to the first paint supply channel, a second switching valve having exit channels for two ways connected to the second paint supply channel, a low pressure air supply valve and a low pressure thinner supply valve disposed respectively to a manifold in communication with the paint hose in which respective exit channels for one way of the first switching valve and the second switching valve are connected by way of the manifold to the paint hose, while respective exit channels for the other way of the switching valves are connected by way of the respective liquid discharging ON-OFF valves to a liquid discharge channel that leads to a liquid discharge tank.

According to this invention, since the first and the second paint supply channels connected with the first and the second color-change devices are respectively cleaned by the cleaning air and the cleaning thinner supplied from the first and the second color-change devices respectively, while the paint hose connected to the electrostatic coating machine is cleaned by the cleaning air at low pressure and the cleaning thinner at low pressure supplied from the low pressure air supply valve and the low pressure thinner supply valve, it is possible to significantly shorten the cleaning time, avoid the contaminations and remaining of paint color which have occurred so far, and prevent contaminations in the peripheral equipments and the electrostatic coating machine main body due to the scattering of the paint from the atomizing cup of the coating machine to the outside of the shroud.

BRIEF DESCRIPTION OF THE DRAWINGS

These and other objects, as well as advantageous features of this invention will now be described more in detailes by way of its preferred embodiment while referring to the drawings, wherein FIG. 2 is a time chart for illustrating one embodiment of the cleaning device according to this invention.

DESCRIPTION OF THE PREFERRED EMBODIMENT

Figure 1:
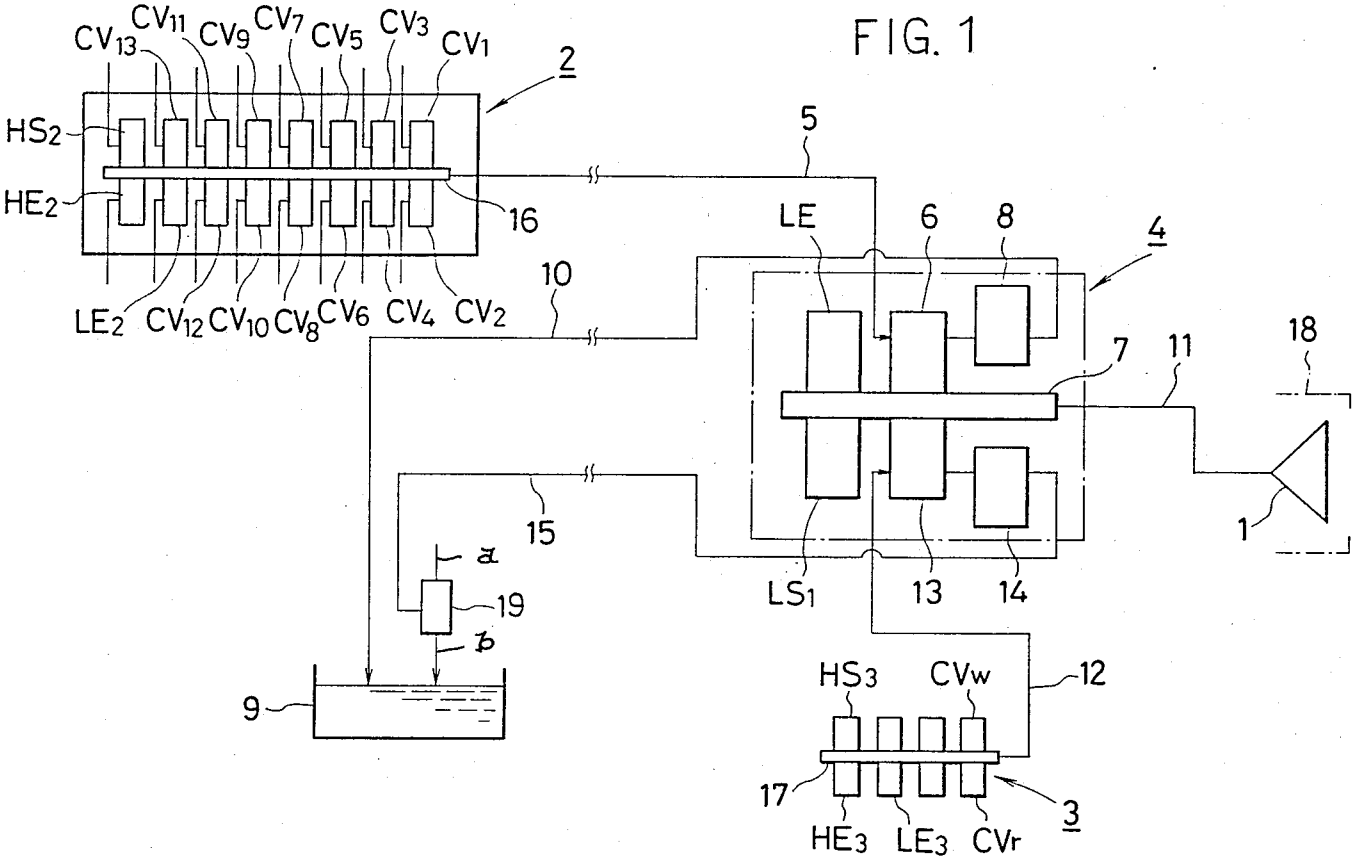
FIG. 1 is a system chart showing the schematic constitution for one embodiment of an electrostatic multi-color coating apparatus to which this invention is applied.

FIG. 1 is a system chart showing the schematic constitution of a cleaning device upon color-change in an electrostatic multi-color coating apparatus according to this invention.

In the drawings, the cleaning device comprises an atomizing cup or bell 1 of an electrostatic coating machine which applied with a high voltage and rotationally driven at a high speed (hereinafter simply referred to as a cup); a first color-change device 2 supplied with paints of a multiplicity of different colors from a plurality of paint supply sources (not illustrated), cleaning air and cleaning thinner; a second color-change device 3 which is smaller in size than the first color-change device 2 and disposed near the cup 1 of the electrostatic coating machine and supplied with paints of at least one color, a cleaning air at high pressure and a cleaning thinner at high pressure; and a valve mechanism 4 constituted with first and second switching valves 6 and 13, a low pressure air supply valve LE1, a low pressure thinner supply valve LS1, etc. attached to a manifold 7, all of which are described later more specifically, A relatively long paint supply channel 5 is disposed for supplyying a paint of a desired color selected from the first color change device 2 to the cup 1 of the electrostatic coating machine and the channel 5 is connected to a first switching valve 6 having exit channels for two ways.

The switching valve 6 is disposed to the manifold 7, in which one of the exit channels is communicated by way of a liquid discharging ON-OFF valve 8 with a liquid discharge channel 10, which communicates by way of a liquid discharging ON-OFF valve 8 to a liquid discharge tank 9, while the other of the exit channels is connected by way of the manifold 7 to the paint hose 11 connected to the cup 1.

A second supply channel 12 of a rather shorter length is disposed for supplying a paint selected by the second color-change device 3 to the cup 1 of the electrostatic coating machine, and the channel 12 is connected to a second switching valve 13 having exit channels for two ways disposed to the manifold 7.

The switching valve 13 is connected at one exit channel thereof by way of a liquid discharging ON-OFF valve 14 to a discharge liquid channel 15, which is further communicated with a liquid discharge tank 9, while connected at the other exit channel thereof by way of the manifold 7 to the paint hose 11.

A low pressure air supply valve LE1 for supplying a cleaning air at low pressure and a low pressure thinner supply valve LS1 for supplying a cleaning thinner at low pressure are disposed to one end of the manifold 7, which is connected at its the other end with the paint hose 11.

In the first color-change device 2, a plurality of color-change valves CV1–CV13 connected respectively to paint supply sources for various different colors (not illustrated), a low pressure air supply valve LE2 and a high pressure air supply valve HE2 and a high pressure thinner supply valve HS2 are disposed to a manifold 16 connected to the first paint supply channel 5.

In the second color-change device 3, a plurality of color-change valves for supplying those paints used frequently such as a color-change valve CVw for supplying white paint and a color-change valve CVr for supplying red paint, a low pressure air supply valve LE3, a high pressure air supply valve HE3 and a high pressure thinner supply valve HS3 are disposed to a manifold 17 connected to the second paint supply channel 12.

In the drawing, reference numeral 18 denotes a shroud for recovering the discharged liquid blown out from the cup 1. The liquid discharge channel 15 from the ON-OFF valve 14 is connected to the liquid discharge tank 9 by way of an ejector 19. The ejector is a device usually called a jet pump or an ejector which is adapted to jet fluid at high speed and high pressure to cause a low pressure area to which is connected low pressure fluid that is sucked in and discharged hydrodynamically with the jet. The ejector 19 has a port a for introducing a high pressure air stream for sucking liquid paint from the channel 15 by the sudden drop of pressure near the high speed air stream and a discharge port b for discharging the resulting air-paint mixture to the liquid discharge tank 9.

OPERATION OF THE EMBODIMENT

The operation of the device according to this invention having the schematic constitution as shown in FIG. 1 will now be explained specifically also referring to the time chart shown in FIG. 2.

Assuming such a case where a white paint or a red paint most frequently used as the coating color for car bodies is supplied to the color-change valve CVw or CVr of the second color-change device 3 disposed near the cup 1 of the electrostatic coating machine, when a car body, for example, of a white color is conveyed to the coating region, the cup 1 is applied with a high voltage and rotationally driven at a high speed at first.

Then, by opening the second switching valve 13 while closing the first switching valve 6, a flow path is established from the manifold 17 of the second color-change device 3 by way of the second paint supply channel 12, the second switching valve 13, the manifold 7 and the paint hose 11 to the cup 1. The white paint is supplied through the thus formed flow path by opening the color-change valve CVw disposed to the second color-change device 3.

Coating is thus started in which the white paint is electrostatically atomized in and released from the cup 1 to apply electrostatic coating on the surface of the car body being conveyed.

Just before the completion of the coating, by opening the low pressure air supply valve LE3 while closing the color-change valve CVw, a cleaning air at low pressure about at the same level as that of the white paint having been supplied from the color-change valve CVw is sent by way of the manifold 17 to the inside of the second paint supply channel 12.

Thus, the white paint is electrostatically atomized from the cup 1 continuously till the completion of the coating, so that it may be applied to the car body without leaving the not yet painted portion and most of the residual paint which would otherwise remain in the flow path is released under electrostatic atomization and can be used effectively with no loss.

When the coating has thus been completed, the low pressure air supply valve LE3 is closed. Simultaneously, the number of rotation for the cup 1 is reduced and the shroud 18 retractably arranged near the cup 1 is advanced so as to surround the cup 1. Then, after closing the second switching valve 13 and opening the liquid discharging ON-OFF valve 14, the high pressure air supply valve HE3 and the high pressure thinner supply valve HS3 disposed to the second color-change device 3 are opened alternately to discharge the white paint remaining in the manifold 17 of the second color-change device 3 and in the second paint supply channel 12 by way of the liquid discharge channel 15 into the liquid discharge tank 9, whereby the insides of the manifold 17 and the second paint supply channel 12 are cleaned rapidly.

Simultaneously, the low pressure air supply valve LE1 and the low pressure thinner supply valve LS1 are opened and closed alternately thereby supplying an air at low pressure and a thinner at low pressure to blow the white paint remaining insides of the manifold 7 and the paint hose 11 out of the cup 1 of the coating machine. The paint thus blown out is recovered in the shroud 18 and the cleaning operation is thus completed.

Since the insides of the manifold 17 of the second color-change device 3 equipped with the color-change valves CVw, CVr, etc. and the insides of the paint hose 11 and the cup 1 are cleaned simultaneously, the time required for cleaning can be shortened significantly.

Particularly, if the residual paint or the like in the second paint supply channel 12 is discharge to the liquid discharge tank 9 by supplying the cleaning air at high pressure and the cleaning thinner at high pressure from the second color-change device 3 together with simultaneous actuation of the ejector 19 connected to the end of the liquid discharge channel 15, the cleaning time can further be shortened, as well as the inside of the manifold 17 and the inside of the second paint supply channel 12 can be cleaned thoroughly to avoid the contamination or remaining of the paint color, whereby the mixing of colors can be prevented to improve the coating quality.

In addition, since the paint and the paint-containing cleaning thinner are blown out of the cup 1 under a reduced pressure, there is no worry that they are scattered externally out of the shroud 18 to contaminate the peripheral equipments or the electrostatic coating machine main body.

Subsequent to the coating of the white color followed by cleaning, when it is intended to change color of paint from white to that of a paint (for example, blue) supplied to the color-change valve CV1, for instance, of the first color-change device 2, the first switching valve 6 is opened and the second switching valve 13 is closed to establish a flow path from the manifold 16 of the first color-change device 2 by way of the first paint supply channel 5, the first switching valve 6, the manifold 7 and the paint hose 11 to the cup 1. Then, the number of rotation for the cup 1 is increased to a predetermined level after retracting the shroud 18 from the cup 1.

Then, the color-change valve CV1 is opened and the blue paint supplied thereto is sent through the above-mentioned flow path to the cup 1 to start the coating and apply electrostatic coating to a succeeding car body now being conveyed.

Just before the completion of the coating, the cleaning air at low pressure about at the same level as that of the paint supplied from the color-change valve CV1 is sent to the inside of the first paint supply channel 5 by closing the color-change valve CV1 and opening the low pressure air supply valve LE2.

In this way, the paint in the first paint supply channel 5 is supplied to and electrostatically atomized in the cup 1 continuously till the completion of the coating, so that most of the paint which would otherwise remain usually in the first paint supply channel 5 is electrostatically atomized from the cup 1 and can be used effectively with no loss.

When the coating has thus been completed, the low pressure air supply valve LE2 is closed, the number of rotation for the cup 1 is reduced and the shroud 18 is advanced so as to surround the cup 1.

Then, after closing the first switching valve 6 and opening the liquid discharging ON-OFF valve 8, the high pressure air supply valve HE2 and the high pressure thinner supply valve HS2 disposed to the first color-change device 2 are alternately opened to discharge the paint remaining to the inside of the first paint supply channel 5 by way of the liquid discharge channel 10 to the liquid discharge tank 9, by which the inside of the manifold 16 and the inside of the first paint supply channel 5 are cleaned rapidly. Also in this case, after closing the first switching valve 6, the low pressure air supply valve LE1 and the low pressure thinner supply valve LS1 disposed to the manifold 7 of the valve mechanism 4 are opened alternately to supply the cleaning air at low pressure and the cleaning thinner at low pressure through the manifold 7 to the inside of the paint hose 11, by which the inside of the paint hose 11 and the inside of the cup 1 are cleaned.

Accordingly, since the inside of the relatively long first paint supply channel 5 is cleaned rapidly by the cleaning air at high pressure and the cleaning thinner at high pressure supplied from the first color-change device 2 and, simultaneously, the inside of the short paint hose 11 and the inside of the cup 1 are cleaned by the cleaning air at low pressure and the cleaning thinner at low pressure supplied respectively from the low pressure air supply valve LE1 and the low pressure thinner supply valve LS1 disposed separately, the cleaning time upon color-change can significantly be shortened. In addition, since the paint and the paint-containing thinner are blown out under reduced pressure from the cup 1 also in this case, there is no worry that they are scattered around to the outside of the shroud 18 to thereby contaminate the peripheral equipments or the electrostatic coating machine main body.

As has been described above according to this embodiment, since a paint of a particular color used frequently is supplied from the second color-change device 3 disposed near the head 1 of the electrostatic coating machine by way of the rather short second paint supply channel 12 and the paint hose 11 to the cup 1, the required amount of the paint can be economized.

In addition, since the paint in the relatively long first paint supply channel 5 connected between the first color-change device 2 and the first switching valve 6, as well as the paint in the second paint supply channel 12 connected between the second color-change device 3 and the second switching valve 13 are supplied by way of the cleaning air at low pressure to the cup 1 before the completion of the coating, the residual amount of the paint remaining in the first and the second paint supply channels 5 and 12 is extremely small and, therefore, the amount of the paint discharged as the liquid wastes at the completion of the coating can be minimized to eliminate the wasteful loss of the paint, as well as improve the cleaning effect.

Further, in the case of cleaning upon color-change of paints that have been supplied from the first and the second color-change devices 2, 3, since the insides of the first and the second paint supply channels 5 and 12 are cleaned rapidly by the cleaning air at high pressure and the cleaning thinner at high pressure supplied from the first and the second color-change devices 2 and 3 respectively, as well as the inside of the paint hose 11 is cleaned by the cleaning air at low pressure and the cleaning thinner at low pressure supplied from the low pressure air supply valve LE1 and the low pressure thinner supply valve LS1 of the valve mechanism 4 disposed near the electrostatic coating machine, the cleaning time can significantly be shortened.

In addition, since the inside of the paint hose 11 and that of the cup 1 are cleaned by the cleaning air at low pressure and the cleaning thinner at low pressure, there is no worry that the paints and the like remaining in the paint hose 11 are scattered around to the outside of the shroud 18 to contaminate the peripheral equipments and the electrostatic coating machine main body when they are blown out of the cup 1 as experienced so far.

According to this invention, as has been described above, since the first and the second paint supply channels connected to the first and the second color-change devices are cleaned with the cleaning air and the cleaning thinner supplied from the first and the second color-change devices respectively, as well as the inside of the paint hose connected to the electrostatic coating machine is cleaned by the cleaning air at low pressure and the cleaning thinner at low pressure sent from the low pressure air supply valve and the low pressure thinner supply valve, the cleaning time can significantly be shortened, this invention can provide excellent effects capable of avoiding the contamination or remaining of paint color in the manifold of the color-change device equipped with the color-change valves and the paint supply channels, as well as being free from the contamination of the peripheral equipments and the electrostatic coating machine main body which would otherwise caused by the paint scattered around from the cup of the coating machine to the outside of the shroud.

What is claimed is:

1. A cleaning device upon color-change in an electrostatic multi-color electrostatic coating apparatus comprising:

a first color-change device comprising a first manifold including valves for supplying respective paints of different colors, a cleaning air and a cleaning thinner selectively through a first paint supply channel;

a second color-change device smaller in size than said first color-change device, disposed near the electrostatic coating machine and comprising a second manifold including valves for supplying respective paints of different colors, a cleaning air and a cleaning thinner selectively through a second paint supply channel; and a valve mechanism disposed near said electrostatic coating machine for supplying a paint supplied from said first color-change device or said second color-change device selectively through said first paint supply channel or said second paint supply channel to an electrostatic coating machine by way of a common paint hose, wherein said valve mechanism comprises a third manifold in communication with said hose and including a first switching valve having two exit channels selectively connectable to said first paint supply channel, a second switching valve having two exit channels selectively connectable to said second paint supply channel, and a low pressure air supply valve and a low pressure thinner supply valve, in which one of the exit channels of said first switching valve and one of the exit channels of said second switching valve are connected by way of said third manifold to said paint hose, while the other of the exit channels of said switching valves are connected by ON-OFF valves to a liquid discharge channel which leads to a liquid discharge tank.

2. A cleaning device as defined in claim 1, wherein an ejector is connected to end of the liquid discharge channel adjacent to the discharge tank.

* * * * *